US008688382B2

(12) United States Patent
Spencer

(10) Patent No.: US 8,688,382 B2
(45) Date of Patent: Apr. 1, 2014

(54) DETECTION OF DOWNHOLE VIBRATIONS USING SURFACE DATA FROM DRILLING RIGS

(75) Inventor: Reed W. Spencer, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 337 days.

(21) Appl. No.: 13/189,680

(22) Filed: Jul. 25, 2011

(65) Prior Publication Data

US 2013/0030706 A1 Jan. 31, 2013

(51) Int. Cl.
*G06F 19/00* (2011.01)

(52) U.S. Cl.
USPC ..... 702/9; 702/6; 175/56; 703/2; 703/7; 703/10; 73/152.43; 73/152.58; 367/25; 367/57; 367/81

(58) Field of Classification Search
USPC ..... 702/6, 9; 175/24, 40, 45, 56, 57; 166/250.01, 369, 301, 177.2, 177.6, 166/56; 703/152.43, 152.58; 367/25, 57, 81
See application file for complete search history.

(56) References Cited

U.S. PATENT DOCUMENTS

| | | | | |
|---|---|---|---|---|
| 4,903,245 | A * | 2/1990 | Close et al. | 340/853.3 |
| 5,313,829 | A * | 5/1994 | Paslay et al. | 73/152.58 |
| 5,402,677 | A * | 4/1995 | Paslay et al. | 73/152.43 |
| 6,732,052 | B2 * | 5/2004 | Macdonald et al. | 702/6 |
| 7,540,337 | B2 * | 6/2009 | McLoughlin et al. | 175/45 |
| 7,551,516 | B2 * | 6/2009 | Harmon | 367/25 |
| 7,710,822 | B2 * | 5/2010 | Harmon | 367/25 |
| 7,748,474 | B2 * | 7/2010 | Watkins et al. | 175/56 |
| 8,214,188 | B2 * | 7/2012 | Bailey et al. | 703/10 |
| 8,453,764 | B2 * | 6/2013 | Turner et al. | 175/70 |
| 8,504,342 | B2 * | 8/2013 | Bailey et al. | 703/10 |
| 2002/0120401 | A1 * | 8/2002 | Macdonald et al. | 702/6 |
| 2006/0203614 | A1 * | 9/2006 | Harmon | 367/57 |
| 2007/0289778 | A1 * | 12/2007 | Watkins et al. | 175/40 |
| 2009/0012711 | A1 * | 1/2009 | Harmon | 702/9 |
| 2012/0123757 | A1 * | 5/2012 | Ertas et al. | 703/2 |
| 2012/0130693 | A1 * | 5/2012 | Ertas et al. | 703/2 |

FOREIGN PATENT DOCUMENTS

| | | | |
|---|---|---|---|
| EP | 0550254 | A2 | 7/1993 |
| WO | 2011017627 | A1 | 2/2011 |

OTHER PUBLICATIONS

Leine, R.I. et al., Stick-slip Whirl Interaction in Drillstring Dynamics, Apr. 2002, 209-220, vol. 124, Issue 2, ASME.
Notification of Transmittal of the International Search Report and the Written Opinion of the International Searching Authority, or the Declaration; PCT/US2012/047955; Jan. 21, 2013.

* cited by examiner

*Primary Examiner* — Carol S Tsai
(74) *Attorney, Agent, or Firm* — Cantor Colburn LLP

(57) ABSTRACT

Disclosed is a method for estimating downhole lateral vibrations a drill tubular disposed in a borehole penetrating the earth or a component coupled to the drill tubular. The method includes rotating the drill tubular to drill the first borehole and performing a plurality of measurements in a time window of one or more parameters of the drill tubular at or above a surface of the earth during the rotating using a sensor. The method further includes estimating the downhole lateral vibrations using a processor that receives the plurality of measurements.

17 Claims, 3 Drawing Sheets

DETECTION OF DOWNHOLE VIBRATIONS USING SURFACE DATA FROM DRILLING RIGS

BACKGROUND

Boreholes are drilled deep into the earth for many applications such as carbon sequestration, geothermal production, and hydrocarbon exploration and production. A borehole is typically drilled by turning a drill bit disposed at the distal end of a drill tubular such as a drill string. As the depth of the borehole increases requiring longer and longer drill strings, various types of vibrations are induced in the drill string and the drill bit due to flexing of the drill string. Lateral vibrations while drilling are considered dysfunctions that often decrease the rate of penetration (ROP) and damage drill bits and bottom hole assembly (BHA) components. Hence, it would be well received in the drilling industry if economical techniques could be developed to detect, estimate, and analyze lateral vibrations in order to improve the ROP and decrease the risk of damage to drill bits and BHA components.

BRIEF SUMMARY

Disclosed is a method for estimating downhole lateral vibrations a drill tubular disposed in a borehole penetrating the earth or a component coupled to the drill tubular. The method includes rotating the drill tubular to drill the first borehole and performing a plurality of measurements in a time window of one or more parameters of the drill tubular at or above a surface of the earth during the rotating using a sensor. The method further includes estimating the downhole lateral vibrations using a processor that receives the plurality of measurements.

Also disclosed is an apparatus for estimating downhole lateral vibrations of a drill tubular disposed in a borehole penetrating the earth or a component coupled to the drill tubular. The apparatus includes a sensor configured to perform a plurality of measurements in a time window of one or more parameters of the drill tubular at or above a surface of the earth during rotating of the drill tubular to further drill the borehole. The apparatus further includes a processor configured to receive the plurality of measurements and to estimate the downhole lateral vibrations using the plurality of measurements.

Further disclosed is a non-transitory computer-readable medium having computer-executable instructions for estimating downhole lateral vibrations of a drill tubular disposed in a borehole penetrating the earth or a component coupled to the drill tubular by implementing a method. The method includes receiving a plurality of measurements of one or more parameters of the drill tubular at or above a surface of the earth while the drill tubular is rotating to drill the borehole, the plurality of measurements being performed in a time window. The method further includes estimating the downhole lateral vibrations using the plurality of measurements.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the Figures.

Figure 1:
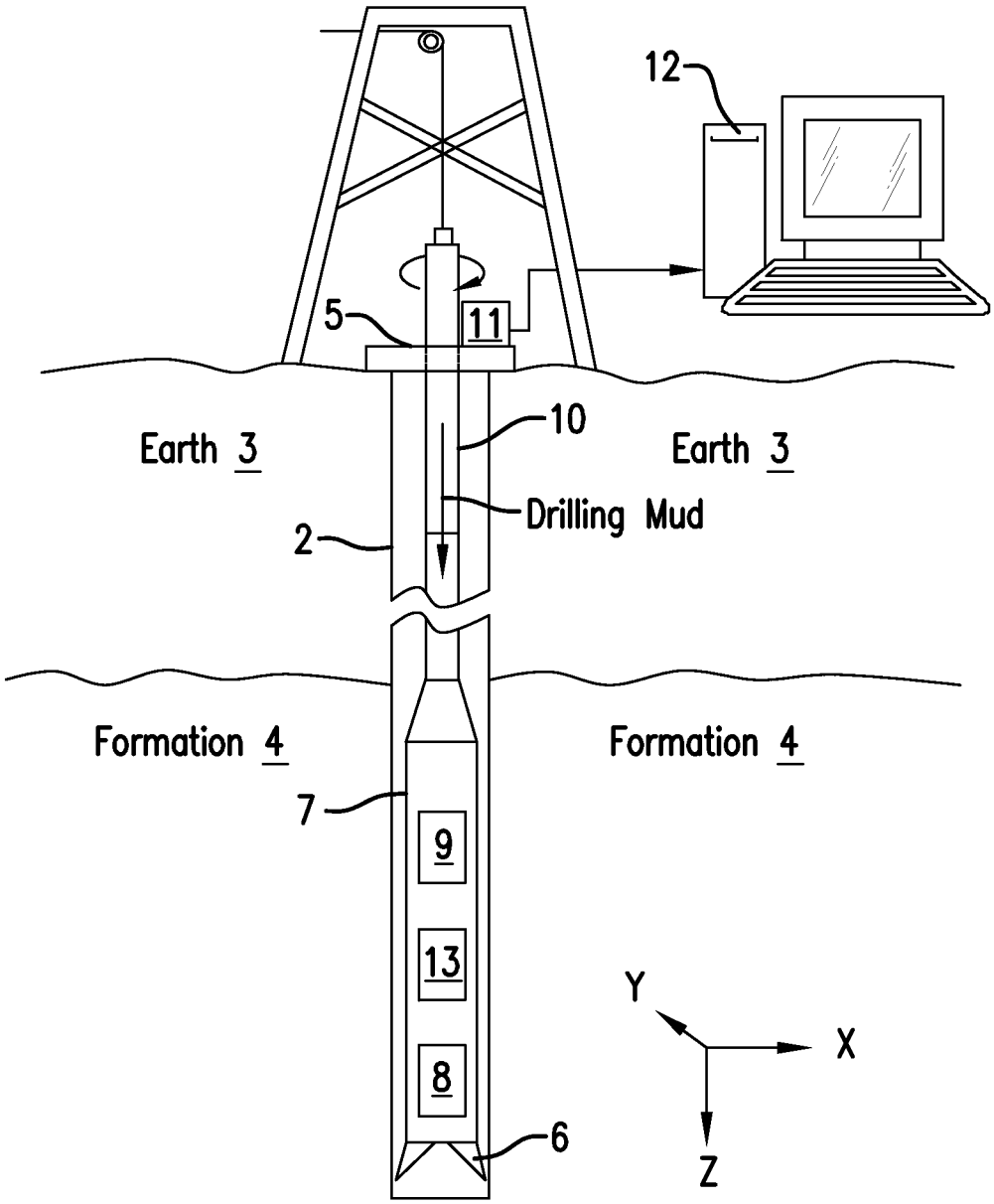
FIG. 1 illustrates an exemplary embodiment of a drill string disposed in a borehole penetrating the earth.

FIG. 1 illustrates an exemplary embodiment of a drill string 10 disposed in a borehole 2 penetrating the earth 3, which includes a geologic formation 4. A drill string rotation system 5 disposed at the surface of the earth 3 is configured to rotate the drill string 10 in order to rotate a drill bit 6 disposed at the distal end of the drill string 10. The drill bit 6 represents any cutting device configured to cut through the earth 3 or rock in the formation 4 in order to drill the borehole 2. Disposed adjacent to the drill bit 6 is a bottom hole assembly (BHA) 7. The BHA 7 can include downhole components such as a mud motor 8 or a logging tool 9. The term "downhole" as a descriptor relates to being disposed in the borehole 2 as opposed to being disposed outside of the borehole 2 such as at or above the surface of the earth 3.

Still referring to FIG. 1, a sensor 11 is disposed at or above the surface of the earth 3. The sensor 11 is configured to perform a measurement of a parameter of a portion of the drill string 10 not disposed in the borehole 2. That is, the parameter being measured by the sensor 11 is at or above the surface of the earth 3. Non-limiting embodiments of the surface parameter include torque applied to the drill string 10, such as by the drill string rotation system 5, and rate of penetration (ROP) of the drill string 10 and thus the drill bit 6 into the earth 3. It can be appreciated that the sensor 11 can be configured to measure the surface parameter either directly or indirectly. For example, for an electrically powered drill string drill string rotation system 5, electrical current may be used as an indication of drill string Torque applied by the motor 5.

Still referring to FIG. 1, a computer processing system 12 is coupled to the sensor 11 and is configured to receive a plurality of measurements of one or more surface parameters of the drill string 10. The computer processing system 12 includes a processor for executing an algorithm for estimating lateral vibrations (i.e., accelerations) of the BHA 7, the drill bit 6, or a portion of the drill string 10 disposed in the borehole 2. The term "lateral" relates to accelerations in an X-Y plane perpendicular to a longitudinal Z-axis of the borehole 2. The algorithm is configured to use only one or more surface parameters as input to estimate the downhole lateral vibrations. A downhole sensor 13 is configured to measure lateral vibrations in order to provide data to develop, fine tune or adjust the algorithm. Measurements by the downhole sensor 13 may be performed while the surface sensor 11 also performs measurements or while similar boreholes are drilled in similar rock conditions without the surface sensor 11 performing measurements. Once the algorithm is developed or fine tuned, the downhole lateral vibrations can be estimated using only surface parameter measurements obtained by the sensor 11. That is, the algorithm does not receive input from the downhole sensor 13 in order to estimate the downhole lateral vibrations. In one or more embodiments, data obtained by the downhole sensor 13 is stored in the sensor 13 until it can be retrieved when the sensor 13 is extracted from the borehole 2.

The algorithm, which models the drill string and downhole components, is based on measured surface parameters obtained by the sensor 11 and downhole data obtained by the downhole sensor 13. It is observed that: an increase in a moving average of drill string torque is a sign of lateral vibration; a decrease in variation of drill string torque is a sign of lateral vibration; and an increase in lateral vibrations lead to a decrease in ROP.

In one or more embodiments, the downhole sensor 13 records lateral accelerations for five seconds at a 500 Hz sampling rate. From this downhole data, the mean and variance for the translational accelerations in the x and y directions are calculated. Lateral acceleration values (i.e., root-mean-square values) are then calculated using the Equation (1) and stored downhole until retrieved. It is also possible to wait until the downhole data is retrieved to calculate the lateral acceleration values.

$$\text{Lateral acceleration}=[(\text{Lateral acceleration mean})^2+(\text{Lateral acceleration variance})]^{1/2} \quad (1)$$

The lateral acceleration value is itself an estimate of the general severity of the vibrations that the downhole sensor 13 recorded the five-second recording interval.

Equation (2) is an empirically developed model based on measurements of surface parameters obtained from the sensor 11 and downhole lateral acceleration measurements obtained by the downhole sensor 13.

$$\text{Lateral Acceleration Estimate} = \frac{\sqrt{T_{ave}}\,(T_{min})(SF)}{\sqrt{\Delta T}\,(ROP+D)} \quad (2)$$

where:

$T_{ave}$ represents an average of drill string torque measured at or above the surface of the earth in a time window;

$T_{min}$ represents a minimum value of drill string torque measured at or above the surface of earth in the time window;

$\Delta T$ represents a torque variation measured at or above the surface of the earth in the time window;

ROP represents a rate of penetration of the drill string into the earth measured at or above the surface of the earth in the time window;

D is a constant; and

SF represents a scale factor.

In one or more embodiments, the torque variation is calculated from a difference between the maximum torque measured in the time window and a minimum torque measured in the time window. The scale factor SF is generally dependent on the diameter of the borehole, the length of the borehole, the BHA, drill tubular components, borehole survey, rock strength, rate of penetration of the drill tubular into the earth, drill bit rotational speed, drill tubular rotational speed, friction factor between the drill tubular and the formation, and/or the type of drilling fluid. In addition, the scale factor is selected in order obtain the estimated downhole lateral acceleration in desired measurement units.

Equation (2) was developed from data from the downhole sensor 13 while drilling a 12.25 inch near vertical borehole. It can be appreciated that the Scale Factor can change from drilling application to drilling application and that it can be determined using data from the downhole sensor 13. It can be appreciated that ROP modifies the shape of the Lateral Acceleration Estimate plot slightly. For instance, increased lateral vibrations often cause a drop in ROP. Thus, ROP is found in the denominator so that as ROP decreases, the value of the lateral vibration estimate increases. In one or more embodiments, the ROP is an average of five feet per hour (fph).

It can be appreciated that the model of Equation (2) can be dependent on the characteristic of the rock or subsurface materials being drilled, on the drill bit 6, or on the BHA 7 or tools in the BHA 7. Hence, Equation (2) can be written more generally as Equation (3) to take into account the various dependencies.

$$\text{Lateral Acceleration Estimate} = \frac{(T_{ave})^a(T_{min})^b(SF)}{(\Delta T)^c(ROP+D)^d} \quad (3)$$

where a, b, c and d are exponents that can be adjusted or fine tuned by comparison with benchmark data obtained from the downhole sensor 13 for a specific drilling application, BHA 7, or drill bit 6.

Equation (3) can be described more generalized as a mathematical function of at least one of $T_{ave}$, $T_{min}$, $\Delta T$, and ROP.

In one or more embodiments, the lateral acceleration estimate can be described by Equation (4).

$$\text{Lateral Acceleration Estimate}=(T_{ave})^a(T_{min})^b(SF)/(\Delta T)^c \quad (4)$$

In one or more embodiments, the lateral acceleration estimate can be described by Equation (5).

$$\text{Lateral Acceleration Estimate}=(T_{min})^b(SF)/(\Delta T)^c \quad (5)$$

In order to determine the values used as inputs to Equations (2) and (3), surface parameter measurements are recorded in a time window and processed to calculate the various values used in the those equations, which may be implemented by the algorithm discussed above. In general, the time window is selected to exceed a time period of a fundamental torsional vibration mode of the drill tubular. In one or more embodiments, the time window is selected from a range of 20 to 70 seconds. It can be appreciated that the downhole lateral vibrations may be determined over an extended period of time by performing the surface measurements in a plurality of time windows. In one or more embodiments, time windows in the plurality of time windows can overlap adjacent time windows. For example, if the plurality of time windows includes a first time window having a first set of measurements and a second time window (following the first window) having a second set of measurements, the second set of measurements can include measurements from the first set in addition to new measurements. In this manner, a moving time window can be used to obtain and process measurements in order to calculate the downhole lateral accelerations over an extended length of time.

Figure 2:
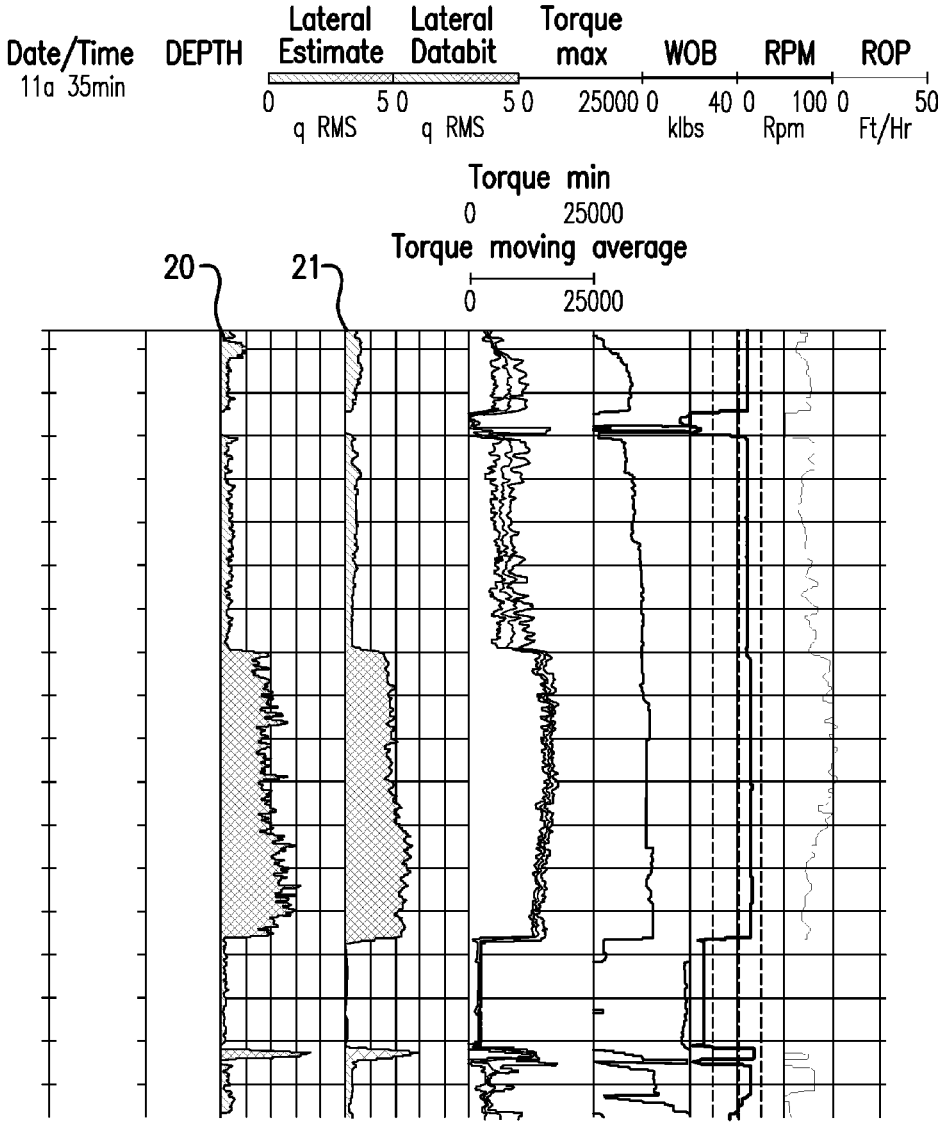
FIG. 2 depicts a comparison downhole lateral vibration data obtained from a downhole sensor with lateral vibration data estimated from measurements of surface parameters of the drill string.

FIG. 2 illustrates a lateral vibration estimate plot 20 calculated using Equation (2) with surface parameters as input and a lateral vibration measurement plot 21 calculated using Equation (1) with lateral acceleration data obtained from the downhole sensor 13. Upon visual inspection, it can be seen that the two plots match quite well. Using linear regression, the plot 20 and the plot 21 were found to correlate at $R^2$=0.82.

Figure 3:
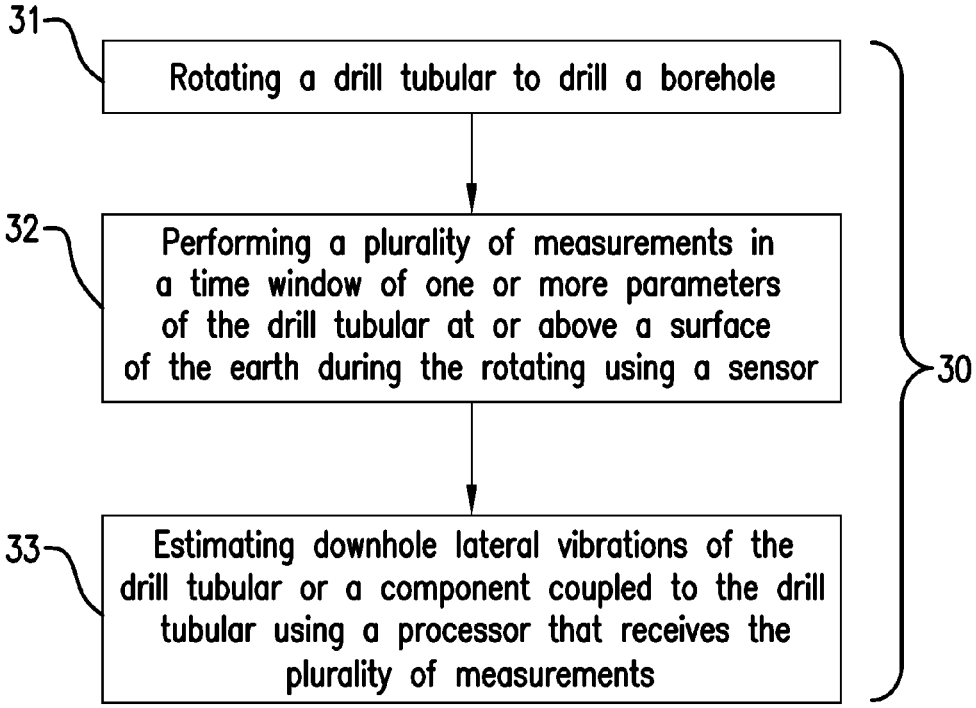
FIG. 3 presents an example of one method for estimating downhole lateral vibrations the drill string or components coupled to the drill string.

FIG. 3 presents one example of a method 30 for estimating downhole lateral vibrations of a drill tubular disposed in a borehole penetrating the earth or a component coupled to the drill tubular. The method 30 calls for (step 31) rotating the drill tubular to drill the borehole. Further, the method 30 calls for (step 32) performing a plurality of measurements in a time window of one or more parameters of the drill tubular at or above a surface of the earth during the rotating using a sensor. Further, the method 30 calls for (step 33) estimating the downhole lateral vibrations using a processor that receives the plurality of measurements. The method 30 can also include fine tuning or adjusting an algorithm or model implemented by the processor by obtaining downhole lateral vibration data from a downhole sensor. In general, step 33 is performed without any downhole lateral acceleration data or other downhole measurements as input once the algorithm is developed or fine tuned.

Estimating downhole lateral vibrations using measurements of surface parameters of the drill string 10 has certain advantages. One advantage is the low cost of obtaining surface measurements of drill string parameters versus the cost and effort to obtain downhole data. Another advantage is the ability to diagnose drill bit whirl, both forward and backward, in real time. Whirl occurs when the drill bit laterally wanders from the z-axis of the borehole colliding with the borehole wall and increasing the diameter of the borehole. The collisions and high-frequency large-magnitude bending moment fluctuations can result in higher than normal component wear and connection fatigue. A further advantage is the ability to analyze downhole component failures or drill bit failures where downhole vibration data is not available in order to determine at what point in the drilling run the damage may have begun.

In support of the teachings herein, various analysis components may be used, including a digital and/or an analog system. For example, the computer processing system 12 may include the digital and/or analog system. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

The term "drill string" as used herein means any tubular to which a drill bit may be coupled for drilling a borehole.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The term "couple" relates to coupling a first component to a second component either directly or indirectly through an intermediate component.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for estimating downhole lateral vibrations of a drill tubular disposed in a first borehole penetrating the earth or a component coupled to the drill tubular, the method comprising:

rotating the drill tubular to drill the first borehole;

performing a plurality of measurements in a series of time windows of one or more parameters of the drill tubular at or above a surface of the earth during the rotating using a sensor; and estimating a series of downhole lateral vibrations corresponding to the series of time windows using a processor that receives the plurality of measurements;

wherein the series of time windows comprises a first time window and a second time window and one or more measurements in the plurality of measurements in the second time window include one or more measurements in the plurality of measurements in the first time window and one or more new measurements.

2. The method according to claim 1, wherein each time window exceeds a time period of a fundamental torsional vibration mode.

3. The method according to claim 1, wherein the one or more parameters comprise at least one of a minimum torque ($T_{min}$) of the drill tubular measured in the time window, a torque variation ($\Delta T$) of the drill tubular measured in the time window, an average torque ($L_{ave}$) of the drill tubular measured in the time window, and a rate of penetration (ROP) of the drill tubular into the earth measured in the time window.

4. The method according to claim 3, wherein the torque variation comprises a difference between a maximum torque and a minimum torque measured in the time window.

5. The method according to claim 3, wherein estimating comprises solving for each time window an equation that is a function of one or more elements in a group consisting of the minimum torque ($T_{min}$), the average torque ($T_{ave}$), the torque variation ($\Delta T$), the rate of penetration (ROP), and a scale factor (SF).

6. The method according to claim 5, wherein estimating comprises calculating the following equation:

$$\text{Lateral Acceleration Estimate} = \frac{(T_{ave})^a (T_{min})^b (SF)}{(\Delta T)^c (ROP + D)^d}$$

where a, b, c, and d are exponents and D is a constant.

7. The method according to claim 6, wherein:

a=½; b=1; c=½; and D=14.

8. The method according to claim 6, wherein:

d=0.

9. The method according to claim 8, wherein:

a=0.

10. The method according to claim 5, further comprising drilling a second borehole prior to the first borehole with a downhole sensor coupled to the drill tubular or the component and configured to sense acceleration in a plane perpendicular to a longitudinal axis of the borehole and determining the equation using data from the downhole sensor.

11. The method of claim 10, wherein the downhole lateral vibrations are estimated without input from the downhole sensor.

12. The method according to claim 1, wherein the component comprises a bottom hole assembly, a logging tool, or a drill bit.

13. An apparatus for estimating downhole lateral vibrations of a drill tubular disposed in a borehole penetrating the earth or a component coupled to the drill tubular, the apparatus comprising:

a sensor configured to perform a plurality of measurements in a series of time windows of one or more parameters of the drill tubular at or above a surface of the earth during rotating of the drill tubular to further drill the borehole; and a processor configured to receive the plurality of measurements and to estimate a series of downhole lateral vibrations corresponding to the series of time windows using the plurality of measurements;

wherein the series of time windows comprises a first time window and a second time window and one or more measurements in the plurality of measurements in the second time window include one or more measurements in the plurality of measurements in the first time window and one or more new measurements.

14. The apparatus according to claim 13, wherein the sensor is configured to measure at least one of a torque of the drill tubular and rate of penetration of the drill tubular into the earth.

15. The apparatus according to claim 14, wherein the processor is further configured to calculate at least one of a minimum torque ($T_{min}$) of the drill tubular measured in each time window, a torque variation ($\Delta T$) of the drill tubular measured in each time window, an average torque ($T_{ave}$) of the drill tubular measured in each time window, and a rate of penetration (ROP) of the drill tubular into the earth measured in each time window.

16. The apparatus according to claim 15, wherein the processor estimates the downhole lateral vibrations without input from a downhole sensor configured to measure the downhole lateral vibrations while the borehole is being drilled.

17. A non-transitory computer-readable medium comprising computer-executable instructions for estimating downhole lateral vibrations of a drill tubular disposed in a borehole penetrating the earth or a component coupled to the drill tubular by implementing a method comprising:

receiving a plurality of measurements of one or more parameters of the drill tubular at or above a surface of the earth while the drill tubular is rotating to drill the borehole, the plurality of measurements being performed in a series of time windows; and estimating a series of downhole lateral vibrations corresponding to the series of time windows using the plurality of measurements;

wherein the series of time windows comprises a first time window and a second time window and one or more measurements in the plurality of measurements in the second time window include one or more measurements in the plurality of measurements in the first time window and one or more new measurements.

* * * * *